United States Patent [19]

Sutherland et al.

[11] Patent Number: 4,759,975

[45] Date of Patent: Jul. 26, 1988

[54] PAPERMAKER'S WET PRESS FELT HAVING MULTI-LAYERED BASE FABRIC

[75] Inventors: Paul H. Sutherland, Simpsonville; William S. Summer, Jr., Joanna, both of S.C.

[73] Assignee: Asten Group, Inc., Charleston, S.C.

[21] Appl. No.: 927,743

[22] Filed: Nov. 6, 1986

[51] Int. Cl.[4] ..... B32B 5/06

[52] U.S. Cl. ..... 428/234; 139/383 A; 162/DIG. 1; 162/358; 428/225; 428/257; 428/282; 428/300; 428/239

[58] Field of Search ..... 428/234, 257, 300, 282, 428/225, 239; 139/383 A; 162/DIG. 1, 358

[56] References Cited

U.S. PATENT DOCUMENTS

| | | | |
|---|---|---|---|
| 1,268,788 | 4/1918 | Brooks | 428/229 |
| 1,801,081 | 4/1931 | Hindle | 139/383 |
| 1,812,148 | 6/1931 | Hindle | 139/383 |
| 1,834,343 | 12/1931 | Hindle | 139/383 |
| 2,110,388 | 3/1938 | Asten | 139/383 |
| 2,180,054 | 11/1939 | Hindle et al. | 139/408 |
| 2,540,874 | 2/1951 | Geddings | 139/383 |
| 2,589,765 | 3/1952 | Berglund | 28/76 |
| 2,797,713 | 7/1957 | Hoffacker | 139/411 |
| 2,854,032 | 9/1958 | Santos | 139/411 |
| 2,947,328 | 8/1960 | Asten et al. | 139/412 |
| 2,949,134 | 8/1960 | Hindle et al. | 139/426 |
| 3,214,326 | 10/1965 | Lee | 162/205 |
| 3,885,603 | 5/1975 | Slaughter | 139/425 |
| 4,086,941 | 5/1978 | Thompson | 139/387 |
| 4,119,753 | 10/1978 | Smart | 428/234 |
| 4,141,388 | 2/1979 | Romanski et al. | 139/383 A |
| 4,151,323 | 4/1979 | Christie | 428/235 |
| 4,182,381 | 1/1980 | Gisbourne | 139/383 A |
| 4,187,618 | 2/1980 | Diehl | 34/243 |
| 4,224,372 | 9/1980 | Romanski | 428/257 |
| 4,259,394 | 3/1981 | Khan | 428/229 |
| 4,267,226 | 5/1981 | Kohler et al. | 428/223 |
| 4,283,454 | 8/1981 | Buchanan | 428/233 |
| 4,290,209 | 9/1981 | Buchanan | 34/123 |
| 4,351,874 | 9/1982 | Kirby | 428/229 |
| 4,356,225 | 10/1982 | Dufour | 428/234 |
| 4,461,803 | 7/1984 | Booth et al. | 428/300 |
| 4,537,816 | 8/1985 | Booth et al. | 428/234 |

FOREIGN PATENT DOCUMENTS

| | | |
|---|---|---|
| 653796 | 1/1965 | Belgium . |
| 0044053 | 1/1982 | European Pat. Off. . |
| 731243 | 2/1943 | Fed. Rep. of Germany . |
| 323392 | 3/1903 | France . |
| 801440 | 9/1958 | United Kingdom . |
| 963212 | 7/1964 | United Kingdom . |

*Primary Examiner*—James J. Bell

*Attorney, Agent, or Firm*—Volpe and Koenig

[57] ABSTRACT

A papermaker's multilayer fabric having at least top and bottom layers of machine direction yarns which are interwoven with cross machine direction yarns systems to establish a first interwoven fabric layer which is bound to a bottom layer fabric with the two being united by interweaving cross machine direction yarns from the bottom fabric layer in the upper fabric layer. The effective pressing surface area of the first fabric layer being equal to or greater than $(x+1)+(0.5y)$. Wherein $(x+1)$ defines the contribution of the upper fabric layer to the effective pressing surface area and the contribution of the binding yarn is defined by the y factor of the equation. Accordingly, the total effective pressing area is defined by the contributions of the upper ply and the binding yarns.

22 Claims, 3 Drawing Sheets

PAPERMAKER'S WET PRESS FELT HAVING MULTI-LAYERED BASE FABRIC

BACKGROUND OF THE INVENTION

This invention relates to papermaker's fabrics and in particular to fabrics, generally known as wet press felts or wet felts which are used in the wet press section of a papermaking machine.

Papermaker's wet felts are designed to transport an aqueous-partially formed web of paper through the press rollers in the wet press section of a papermaking machine and to assist in the further dewatering thereof. In its most common form, a papermaker's wet felt is constructed from a woven base fabric having fibrous batts needled to one or both sides.

The amount of void volume within the base fabric of a wet felt and its dewatering ability is directly related to the amount of water which can be internally handled by the felt construction while in the press nip. In other words, felts which can run with a "dry nip" (no water puddling behind the nip) are less likely to result in crushing or other hydraulic phenomena which are known to those skilled in the art.

It has been recognized in the art that it is possible to maintain a desired controlled void volume within the fabric construction by employing multi-layered base fabrics. One example of such a felt is disclosed in U.S. Pat. No. 4,356,225 which is assigned the assignee of the present invention. The fabric of U.S. Pat. No. 4,356,225 is disclosed as having increased stability while maintaining the machine direction layers in vertical alignment. Other examples are also cited in that patent.

The surfaces of the base fabric of conventional fabrics are predominantly defined by the top and bottom layers of machine direction yarns. The cross machine direction yarns which interweave the multiple layers of machine direction yarns of such fabrics protrude beyond the surfaces of the base fabric with sharp infrequent knuckles. It has been discovered that under the intense pressure of the nip, water removal can be impaired by the extremes of high and low pressure caused by the cross machine direction yarn knuckles on the paper bearing side of the fabric. Also, on the other or machine side of the fabric, the knuckles represent high pressure points which result in accelerated wear of the fabric.

It has been recognized in the art that it is possible to achieve improved pressing service and machine surface contact while maintaining controlled void volume within the fabric construction of multi-layered base fabrics. One example of such a felt is disclosed in U.S. Pat. No. 4,461,803 which is assigned to the assignee of the present invention. The fabric of the U.S. Pat. No. 4,461,803 patent comprises a multi-layered base fabric having both a smooth pressing surface and a roller surface resistant to wear in which the cross machine direction yarns define the predominate surfaces of the base fabric without creating sharp knuckles on either surface of the base fabric. However, in U.S. Pat. No. 4,461,803 construction the binder yarns extend between the top layer and the bottom layer of the fabric as machine direction yarns extend under or above the respective layer, and do not contribute to the pressing pressure points of the water removal surface, the top layer, or the machine roller contact surface, the bottom layer.

It has been recognized in the art that it is possible to utilize two separate fabric layers and to join the two fabric layers by means of an independent binder or a binder system comprised of threads from one of the fabric layers. One example of such a felt is disclosed in U.S. Pat. No. 3,214,326. The fabric of U.S. Pat. No. 3,214,326 which utilizes binder threads from one of the fabric layers results in the binder threads reducing the sheet contact surface area rather than in increasing the sheet surface contact area. The U.S. Pat. No. 3,214,326 construction using individual binder threads need not result in such a reduction of the sheet contact area, however, the binder threads do not contribute to the sheet surface contact area.

SUMMARY AND OBJECT OF THE INVENTION

The present invention provides a papermaker's wet felt for use in the wet press section of a papermaker's machine. The disclosed papermaker's felt comprises a multi-layered base fabric having cross machine yarns which interweave with the multiple layers of machine direction yarns such that two fabrics layers are formed and united with predominantly the cross machine direction yarns defining the top and bottom surfaces of the base fabric. The cross machine direction yarns are woven in a repeat pattern having floats which extend above the top layer of machine direction yarns so as to define the surfaces of the base fabric. Additionally, one of the cross machine direction systems, preferred the bottom system, is used to bind the two fabric layers together. Still further, in the preferred embodiment, the binding yarn complements the weave pattern to increase sheet contact area.

It is an object of the present invention to provide a papermaker's wet felt comprising a multi-layered base fabric having both a smooth pressing surface with increased paper contact and a machine roller side surface resistant to wear.

In particular, it is an object of the invention to provide a system of cross machine direction yarns which interweave multiple layers of machine direction yarns without creating sharp knuckles on either surface of the base fabric of the wet felt.

It is a further object to provide a method of weaving the desired fabric using only two means for interweaving cross machine direction yarns.

Other objects and advantages of the present invention will become apparent from the following portion of the specification and from the accompanying drawings which illustrate a presently preferred embodiment incorporating the principles of the invention.

DETAILED DESCRIPTION

Figure 1:
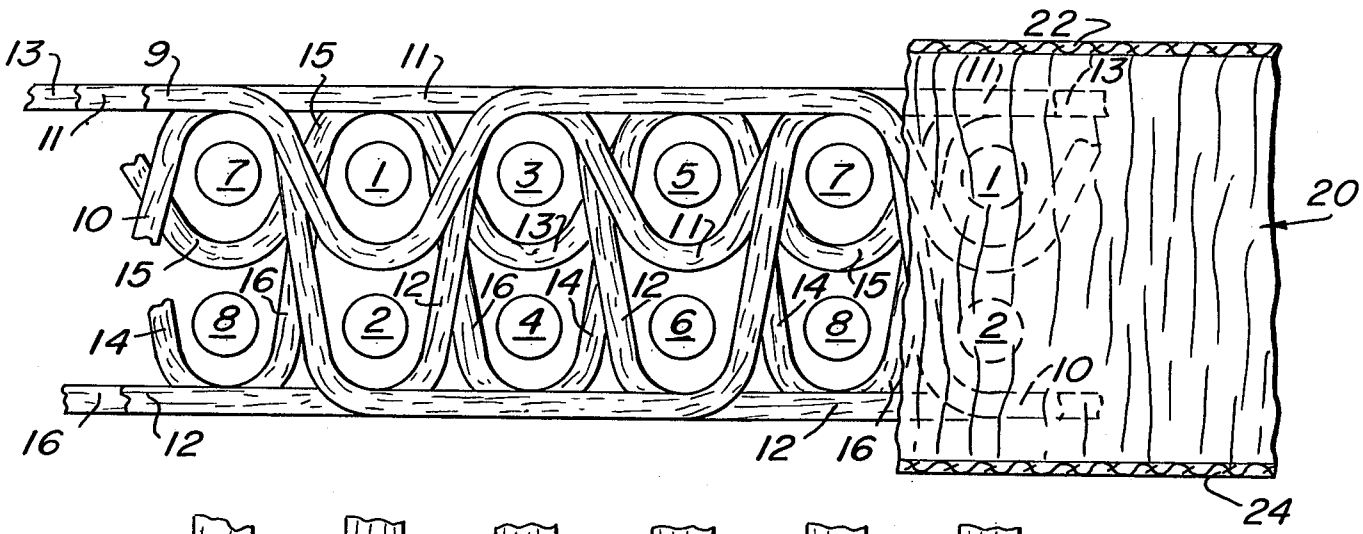
FIG. 1 is a schematic diagram of a papermaker's wet press felt according to the teachings of the present invention.

With reference to the drawing figures, the invention will be described in more detail with like numerals referring to like elements in each of the drawing figures.

With reference to FIG. 1, there is shown an illustrative section cut in the cross machine direction of the fabric. Machine direction yarns are numbered as 1–8 and cross machine direction yarns are numbered as 9–16. All yarns which weave in the upper ply are odd numbered yarns and they weave so as to independently form a complete fabric layer. All yarns which weave primarily in the lower ply are even numbered yarns. As can be seen from FIG. 1, the machine direction yarns 1–8 are substantially vertically aligned and each of the yarns is surrounded and retained in position by a number of cross machine direction yarns. Such a weave pattern contributes to the stability of the fabric and improved void volume control of the final fabric. CMD yarn 9 weaves under MD yarn 1 and over MD yarns 3, 5 and 7. CMD yarn 10 weaves over MD yarns 7 and 8 and under MD yarns 2, 4 and 6. CMD yarn 11 weaves over MD yarns 7, 1 and 3 and under MD yarn 5. CMD yarn 12 weaves under MD yarns 6, 8 and 2 and over MD yarns 3 and 4. CMD yarn 13 weaves over MD yarns 5, 7 and 1 and under MD yarn 3. CMD yarn 14 weaves MD under yarns 8, 2 and 4 and over MD yarns 5 and 6. CMD yarn 15 weaves under MD yarn 7 and over MD yarns 1, 3 and 5. CMD yarn 16 weaves under MD yarns 4, 6 and 8 and over MD yarns 1 and 2.

As can be seen from the above described weave, the CMD yarns will always have a weave repeat which produces a float on the upper and lower surface planes of the fabric of at least two yarns and preferably at least three MD yarns in length. The preferred weave pattern is generally referred to as a 3/1 weave pattern. Likewise, it will be seen that the upper ply will weave in the reversed direction of the bottom ply. It will also be recognized that float lengths of more than three may be used in view of the design application.

Figure 2:
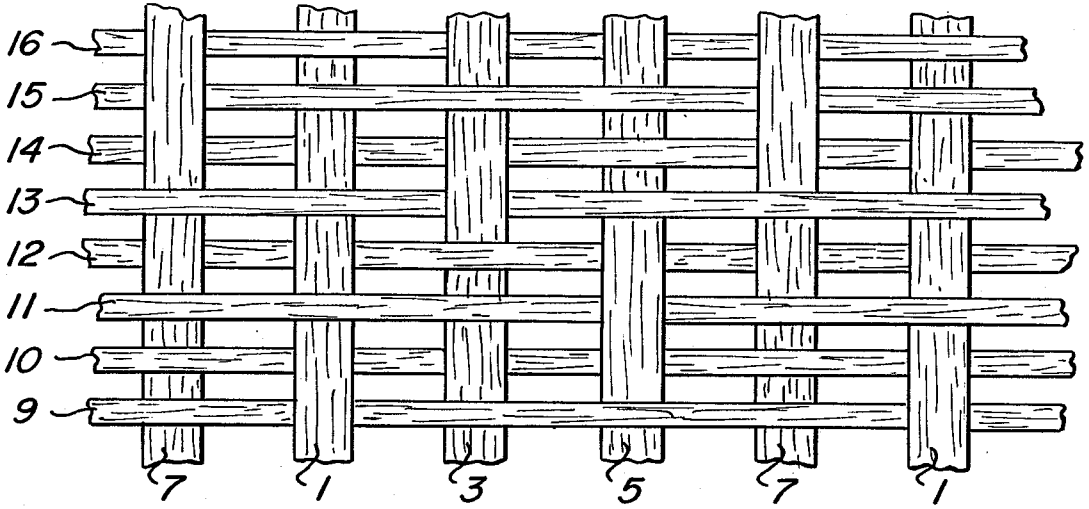
FIG. 2 is a top plan schematic diagram of the weave of FIG. 1.

With reference to FIG. 2, there is shown an exploded schematic top plan view of a fabric as woven in accordance with the description of FIG. 1. It will be recognized by those skilled in the art that FIG. 2 is illustrative of the weave pattern which has been previously described. By reference to FIG. 2, it can be seen that the binding effect accomplished by CMD yarns 10, 12, 14 and 16 are such that each of the yarns will produce a knuckle on the surface plane on the upper layer of the fabric. Through the utilization of such a binding construction, it is therefore possible to supplement the cross machine direction yarns which appear on the upper ply surface by approximately 25%. As will be recognized by those skilled in the art, a 3/1 construction must by definition eliminate approximately 20% to 25% of the cross machine direction yarns from effecting the surface pressing area of the top ply. However, by placing the binder pick from the CMD lower ply yarns in the upper ply surface, it is possible to substantially replace the missing contact surface so as to achieve a top surface plane approximating 100% contact from the CMD yarns.

The above relationship of the effective pressing area of the upper ply surface may be expressed generally by the equation, $EPA=(x+1)+(\text{at least } 0.5y)$, where both x and y are always at least one. In general, the contribution of the y yarn can never be more than 90% and will generally be greater than 50%. The contribution of the y yarn will not exceed 90% due to the normal loss of surface area which results from the interweaving. Likewise, the minimum contribution will preferably always be at least 50% of the y yarn. Those skilled in the art will recognize that the percentage contribution will obviously be related to the beat up during the weaving process and the density of the yarns. As the weave is made loser, the curvature of the knuckle will increase and the percentage contribution will decrease. Likewise, as the fabric is more tightly woven, the percentage contribution will increase.

Figure 3:
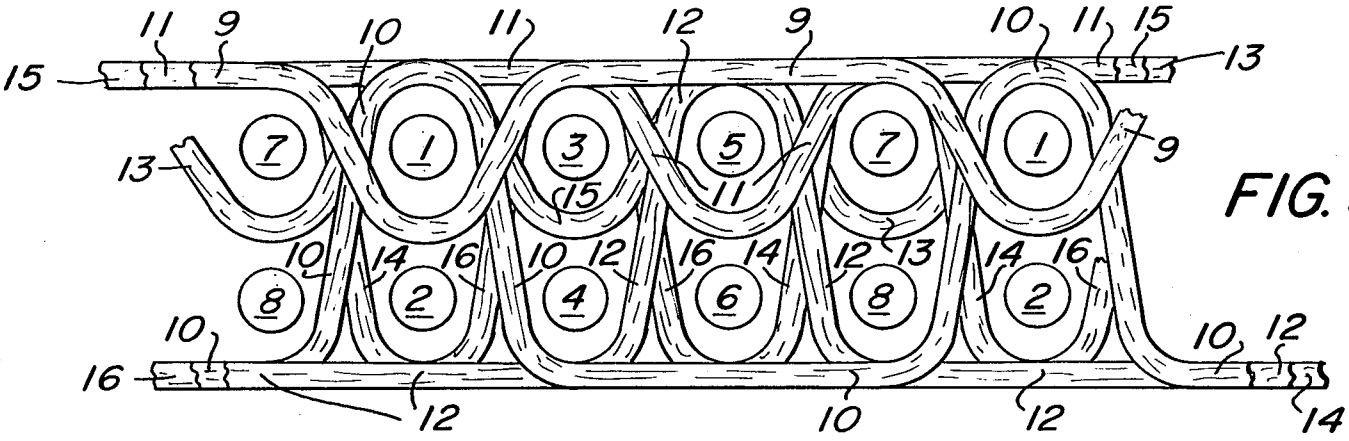
FIG. 3 is a schematic diagram of a second papermaker's wet press felt according to the teachings of the present invention.
Figure 4:
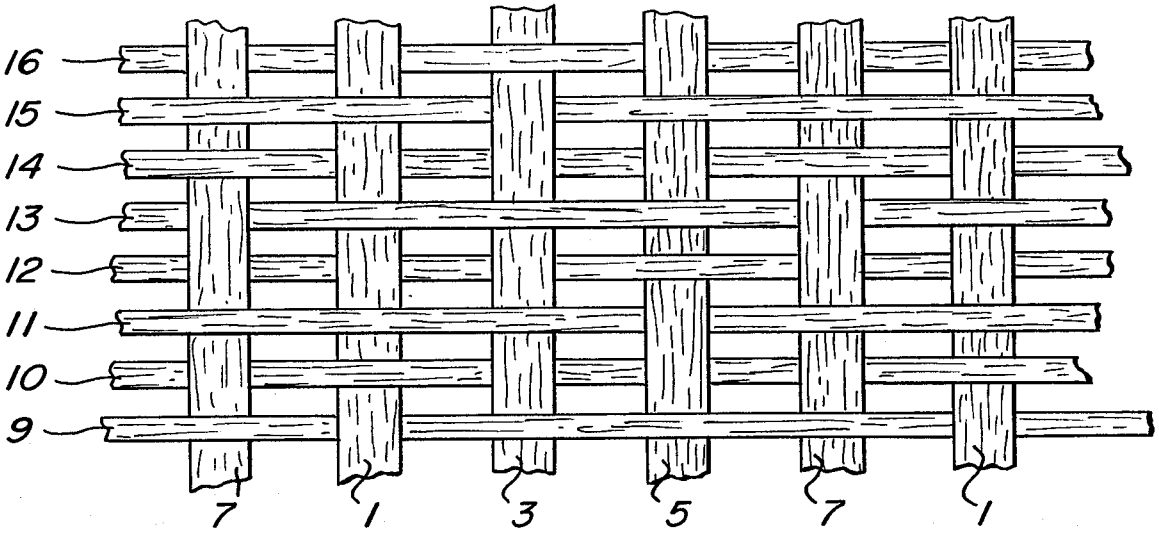
FIG. 4 is a top plan view schematic diagram of the fabric of FIG. 3.

With respect to FIGS. 3 and 4, there is described a second embodiment of the fabric according to the instant invention. Once again, yarns 1–8 are MD yarns with upper ply yarns being odd numbers and bottom ply yarns being even numbers. The CMD yarns are likewise numbered 9–16 as previously discussed. It will be observed that the embodiment of FIGS. 3 and 4 differs from that of FIGS. 1 and 3 in that the weave repeats of the CMD yarns in the upper and lower ply are substantially mirror images.

With reference to FIG. 3, the weave pattern will be described in detail. CMD yarn 9 weaves under MD yarn 1 and over MD yarns 3, 5 and 7. CMD yarn 10 weaves over MD yarns 1 and 2 and under MD yarns 4, 6 and 8. CMD yarn 11 weaves over MD yarns 7, 1 and 3 and under MD yarn 5. CMD yarn 14 weaves over MD yarns 7 and 8 and under MD yarns 2, 4 and 6. CMD yarn 15 weaves over MD yarns 7, 1 and 5 and under MD yarn 3. CMD yarn 16 weaves under MD yarns 2, 4 and 6 and weaves over MD yarns 3 and 4.

Figure 5:
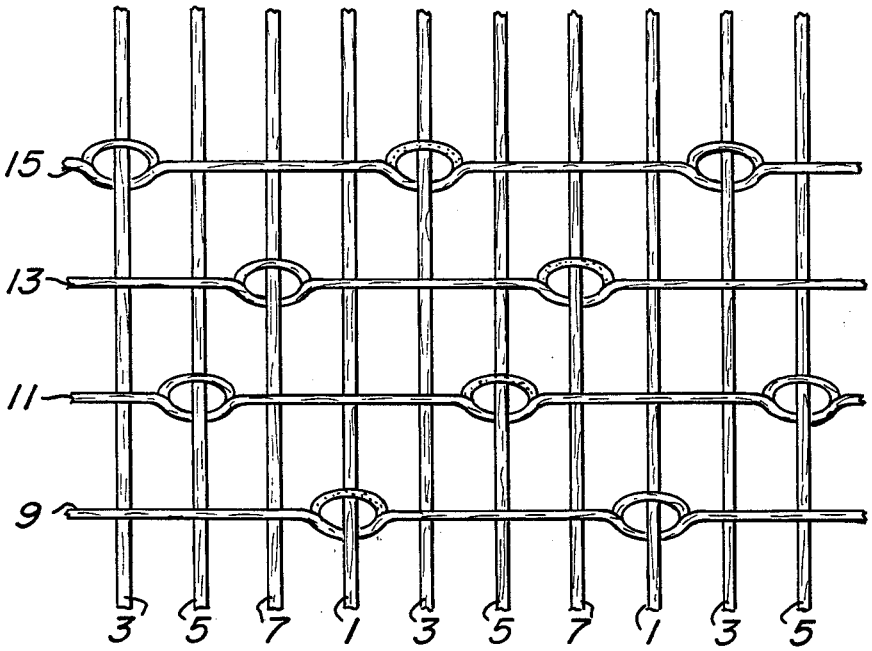
FIG. 5 is a perspective schematic view of the weave of the upper layer of the fabric according to the instant invention.
Figure 6:
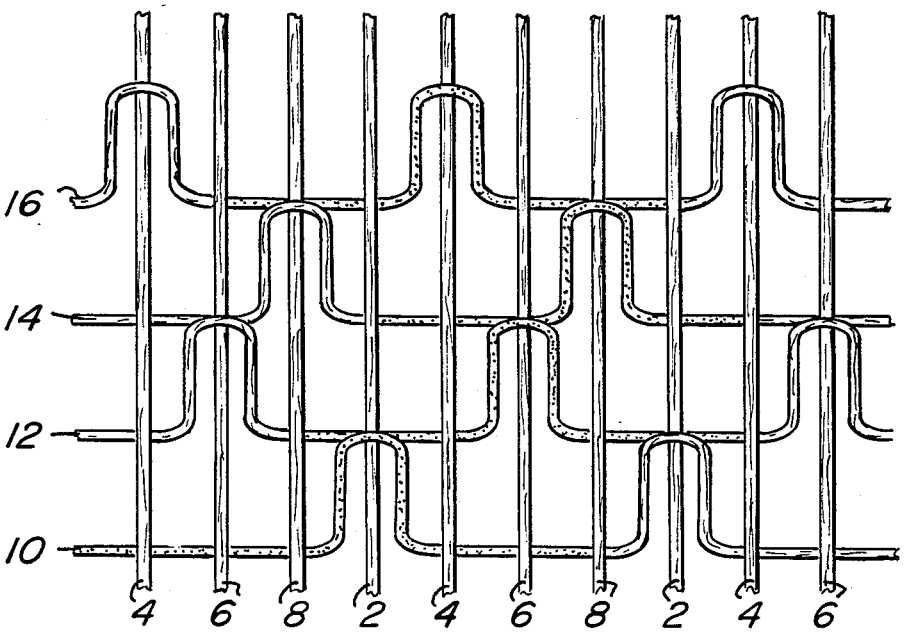
FIG. 6 is a perspective schematic view of the bottom layer fabric according to the instant invention.

With reference to FIG. 4, there is illustrated a similar top plan diagrammatic view of the fabric of FIG. 3, similar to that which was illustrated in FIG. 2 for the fabric of FIG. 1. As will be appreciated by those skilled in the art, it can be seen that the construction of FIG. 3 provides a construction where each of the binder yarns 10–16 provides a knuckle or float on the surface of the upper ply layer which is positioned adjacent to the void in the float surface resulting from the interweaving of CMD yarns 9, 11, 13 and 15. With reference to FIGS. 5 and 6, there is presented a graphic illustration of this phenomena. As can be seen from FIG. 5, each of the lower ply CMD yarns 10–16 will substantially replace the sunken CMD yarn 9, 11, 13 and 15 so as to accomplish a virtually continuous float length for the CMD yarns on the upper ply. Since the binding yarn knuckle complements the weave on the upper ply, it will not produce the objectionable knuckle marking problems noted with the prior art constructions. As noted previously, the binding knuckle complements the top float weave construction so as to improve the surface contact and to avoid interruption generally associated with the sinking of the yarn beneath the machine direction thread. In addition to replacing the sunken CMD yarn of the upper ply, the lower ply CMD binder yarn also provides a counter tension on the respective MD yarn so as to avoid knuckle marking which results from the MD yarn pushing into the surface ply of the fabric.

With reference to FIG. 6, there is illustrated the construction of the lower ply CMD yarns. As can be seen from FIG. 6, each of the binder loops of the lower ply CMD yarns will have a height at least equal to the diameter of 2 MD yarns. In addition, it can be seen that the lower ply does not form a complete fabric construction as does the weave pattern of the upper ply. In addition, it will be seen that through the disclosed system of binder yarns, each pair of vertically arranged MD yarns will be under the influence of a number of binder yarns which will tend to maintain the MD yarns in vertical alignment and stabilize the fabric during operation.

With respect to weaving of the present fabric it will be appreciated by those skilled in the art that the elimination of a third machine direction yarn system about which to bind the yarns will reduce the time and cost of weaving the fabric. Use of an independent binder yarn which does not contribute to the overall weaving of the fabric results in a condition where an additional shuttle or an additional warp is required. Thus, fabric according to the present invention can be woven in an endless system without the need for a dedicated shuttle to insert the binder yarn. Likewise, flat weaving of the fabric is simplified since there is no need to account for an additional warp system for the binder yarn and no need to account for the separate binding system in the idle weave repeat pattern. Accordingly, utilization of cross machine direction binder allows for the elimination of a separate system devoted to binding yarns and increases the weaving speed. Likewise, cross machine direction binding yarns are preferable, as water removal is greatly enhanced by uniform pressure in the nip area. Long floats running parallel to the nip provide optimum pressure points or surface contact as the fabric and paper sheet travel through the nip. In addition, the potential of the cross machine direction binder yarn to recapture a substantial portion of the CMD surface area, which is lost due to the sinking of the upper ply CMD yarns, adds significantly to the dewatering capabilities of the construction. When the increased dewatering capacity is coupled with the stability of the present construction, dewatering and void volume retention are greatly enhanced.

Constructions according to the present invention may find use in certain dryer fabric and forming fabric applications, however, the primary benefit is obtained in using the fabric in the press felt position of the papermaking equipment. In press felt applications, the preferred fabric base will be provided with a felt batt as shown in FIG. 1. Generally the felt batt 20 will be comprised of batt layer 22 and 24 which are needled to the fabric base by techniques known to those skilled in the art. Likewise it will be recognized by those skilled in the art at a single batt layer 22 may be sufficient for certain design applications.

It will be further understood by those skilled in the art that the terms "machine direction yarns" and "cross machine direction yarns" refer to the direction of the yarns as positioned to and operated on the papermaking equipment.

We claim:

1. A multi-layer papermaker's wet press felt comprising:

a top layer of machine direction yarns;

a bottom layer of machine direction yarns;

a first system of cross-machine direction yarns interwoven solely with said top layer of machine direction yarns with floats which extend over at least two top layer machine direction yarns so that said first system cross-machine direction yarns predominate the surface which they form with said top layer machine direction yarns and form a first interwoven layer with said top machine direction yarns; and a second system of cross-machine yarns interwoven with said bottom layer machine direction yarns and selected top layer machine direction yarns with floats which extend under at least two bottom layer machine direction yarns and over at least one top and bottom layer machine direction yarns, so that the said second system of cross-machine direction yarns are interwoven with said bottom layer of machine direction yarns to substantially define a second interwoven layer and to predominate the surface which they define with said bottom layer machine direction yarns.

2. The papermaker's wet press felt of claim 1 wherein said second system of cross machine direction yarns and said bottom layer of machine direction yarns form a complete fabric system which is bound to said first interwoven layer through the interweaving of second system cross machine direction yarns with selected machine direction yarns of said top layer.

3. The papermaker's wet press felt of claim 1 further comprising a batt needled adjacent to said top layer of machine direction yarns.

4. The papermaker's wet press felt of claim 3 further comprising a batt needled adjacent to said bottom layer of machine direction yarns.

5. The papermaker's wet press felt of claim 1 wherein said first interwoven layer is woven in a 3/1 construction.

6. The papermaker's wet press felt according to claim 1 wherein said second system of cross machine direction yarns are interwoven to comprise approximately 20% of the cross machine direction yarns effective pressing surface area of the first interwoven layer.

7. The papermaker's wet press felt of claim 1 wherein said first interwoven layer and said second interwoven layer are woven to be substantially mirror images of each other.

8. A papermaker's wet press felt comprising:

a top layer of machine direction yarn;

a bottom layer of machine direction yarns; and a system of cross-machine direction yarns selectively interwoven with said machine direction for providing the dominate surface yarns of said top and said bottom layer, including:

a first sub-system of cross-machine direction yarns interwoven solely with said top layer machine direction yarns in a repeat pattern having floats extending over at least two top layer machine direction yarns to form a first layer; and a second sub-system of cross-machine direction yarns interwoven with said bottom and said top layer of machine direction yarn in a repeat pattern having floats extending under at least two bottom layer machine directions yarns and over at least one pair of vertically aligned top and bottom layer machine direction yarns.

9. The papermaker's wet press felt of claim 8 wherein said second system of cross machine direction yarns and said bottom layer of machine direction yarns form a complete fabric system which is bound to said first interwoven layer through the interweaving of second system cross machine direction yarns with selected machine direction yarns of said top layer.

10. The papermaker's wet press felt of claim 8 further comprising a batt needled adjacent to said top layer of machine direction yarns.

11. The papermaker's wet press felt of claim 10 further comprising a batt needled adjacent to said bottom layer of machine direction yarns.

12. The papermaker's wet press felt of claim 8 wherein said first interwoven layer is woven in a 3/1 construction 13. The papermaker's wet press felt according to claim 8 wherein said second system of cross machine direction yarns are interwoven to comprise approximately 20% of the cross machine direction yarns effective pressing surface area of the first interwoven layer.

14. The papermaker's wet press felt of claim 8 wherein said first and second sub-systems of cross-machine direction yarns are woven to be substantially mirror images of each other.

15. A papermaker's multi-layer fabric comprising:

a top layer of machine direction yarns;

a bottom layer of machine direction yarns;

a first system of cross-machine direction yarns interwoven solely with said top layer of machine direction yarns with floats which extend over at least (x+1) top layer machine direction yarns so that said first system cross-machine direction yarns predominate the surface which they form with said top layer machine direction yarns and form a first interwoven layer with said top machine direction yarns; and a second system of cross-machine yarns interwoven with said bottom layer machine direction yarns and selected top layer machine direction yarns with floats which extend under at least (x+1) bottom layer machine direction yarns and over at least "y" top and bottom layer machine direction yarns, so that the said second system of cross-machine direction yarns are interwoven with said bottom layer of machine direction yarns to substantially define a second fabric layer and to predominate the surface which they define with said bottom layer machine direction yarns and are also on the surface of said top layer, whereby the cross machine direction yarns effective pressing surface area of the first interwoven layer is equal to or greater than $(x+1)+(0.5y)$.

16. The fabric of claim 15 wherein the effective pressing surface area is equal to or greater than $(x+1)+(0.8y)$.

17. The fabric of claim 15 wherein the effective pressing surface area is no greater than $(x+1)+(0.9y)$.

18. The papermaker's fabric of claim 15 wherein said second system of cross machine direction yarns and said bottom layer of machine direction yarns are bound to said first interwoven layer through the interweaving of second system cross machine direction yarns with selected machine direction yarns of said top layer.

19. The papermaker's fabric of claim 15 further comprising a batt needled adjacent to said top layer of machine direction yarns.

20. The papermaker's fabric of claim 19 further comprising a batt needled adjacent to said bottom layer of machine direction yarns.

21. The papermaker's fabric of claim 15 wherein x is at least 2.

22. The papermaker's wet press felt according to claim 15 wherein said second system of cross machine direction yarns are interwoven to comprise approximately 20% of the cross machine direction yarns effective pressing surface area of the first interwoven layer.

* * * * *